US008124548B2

(12) United States Patent
Ardiff et al.

(10) Patent No.: US 8,124,548 B2
(45) Date of Patent: Feb. 28, 2012

(54) LOW WEIGHT AND HIGH DURABILITY SOFT BODY ARMOR COMPOSITE USING SILICONE-BASED TOPICAL TREATMENTS

(75) Inventors: Henry G. Ardiff, Chesterfield, VA (US); Brian D. Arvidson, Chester, VA (US)

(73) Assignee: Honeywell International Inc., Morristown, NJ (US)

( * ) Notice: Subject to any disclaimer, the term of this patent is extended or adjusted under 35 U.S.C. 154(b) by 348 days.

(21) Appl. No.: 11/962,663

(22) Filed: Dec. 21, 2007

(65) Prior Publication Data

US 2009/0163098 A1 Jun. 25, 2009

(51) Int. Cl.
*B32B 27/04* (2006.01)

(52) U.S. Cl. ..... 442/135

(58) Field of Classification Search ..... 428/911; 442/64, 65, 134, 135, 148
See application file for complete search history.

(56) References Cited

U.S. PATENT DOCUMENTS 4,006,207 A 2/1977 Yeshin ..... 264/108
(Continued)

*Primary Examiner* — Arti Singh-Pandey
(74) *Attorney, Agent, or Firm* — Banner & Witcoff, Ltd.

(57) ABSTRACT

Ballistic resistant articles having abrasion resistance. Particularly, abrasion resistant, ballistic resistant articles and composites having a silicone-based topical treatment.

9 Claims, No Drawings

U.S. PATENT DOCUMENTS

| | | | | |
|---|---|---|---|---|
| 4,780,338 | A | 10/1988 | Saad et al. | 427/387 |
| 4,929,691 | A | 5/1990 | Fillmore et al. | 525/477 |
| 5,064,891 | A | 11/1991 | Fujiki et al. | 524/624 |
| 5,153,258 | A * | 10/1992 | Nakahara et al. | 524/588 |
| 5,167,876 | A * | 12/1992 | Lem et al. | 252/602 |
| 5,262,088 | A | 11/1993 | Hill et al. | 516/121 |
| 5,330,820 | A * | 7/1994 | Li et al. | 428/113 |
| 5,618,595 | A | 4/1997 | Matsushima et al. | 428/35.2 |
| 5,677,029 | A * | 10/1997 | Prevorsek et al. | 428/113 |
| 6,063,473 | A | 5/2000 | Zafiroglu et al. | |
| 6,127,291 | A * | 10/2000 | Coppage et al. | 442/135 |
| 6,341,708 | B1 * | 1/2002 | Palley et al. | 220/1.5 |
| 6,416,624 | B1 | 7/2002 | Nielsen et al. | 162/155 |
| 6,420,037 | B1 | 7/2002 | Tsuji et al. | 428/447 |
| 6,642,159 | B1 * | 11/2003 | Bhatnagar et al. | 442/134 |
| 6,761,673 | B2 | 7/2004 | Shudo | 492/56 |
| 6,841,492 | B2 * | 1/2005 | Bhatnagar et al. | 442/135 |
| 6,846,758 | B2 * | 1/2005 | Bhatnagar et al. | 442/135 |
| 7,226,878 | B2 * | 6/2007 | Wagner et al. | 442/59 |
| 7,686,331 | B2 * | 3/2010 | Li et al. | 280/743.1 |
| 7,718,245 | B2 * | 5/2010 | Bhatnagar et al. | 428/113 |
| 2004/0192142 | A1 | 9/2004 | Zafiroglu et al. | |
| 2007/0015425 | A1 * | 1/2007 | Hill et al. | 442/76 |
| 2007/0099528 | A1 | 5/2007 | Kolmes et al. | |
| 2007/0141250 | A1 | 6/2007 | Mei | 427/213 |
| 2008/0223857 | A1 * | 9/2008 | Palley et al. | 220/560.01 |

* cited by examiner

LOW WEIGHT AND HIGH DURABILITY SOFT BODY ARMOR COMPOSITE USING SILICONE-BASED TOPICAL TREATMENTS

BACKGROUND OF THE INVENTION

1. Field of the Invention

This invention relates to ballistic resistant articles having improved abrasion resistance.

2. Description of the Related Art

Ballistic resistant articles containing high strength fibers that have excellent properties against projectiles are well known. Articles such as bullet resistant vests, helmets, vehicle panels and structural members of military equipment are typically made from fabrics comprising high strength fibers. High strength fibers conventionally used include polyethylene fibers, aramid fibers such as poly(phenylenediamine terephthalamide), graphite fibers, nylon fibers, glass fibers and the like. For many applications, such as vests or parts of vests, the fibers may be used in a woven or knitted fabric. For other applications, the fibers may be encapsulated or embedded in a polymeric matrix material to form woven or non-woven rigid or flexible fabrics. Preferably each of the individual fibers forming the fabrics of the invention are substantially coated or encapsulated by the binder (matrix) material.

Various ballistic resistant constructions are known that are useful for the formation of hard or soft armor articles such as helmets, panels and vests. For example, U.S. Pat. Nos. 4,403,012, 4,457,985, 4,613,535, 4,623,574, 4,650,710, 4,737,402, 4,748,064, 5,552,208, 5,587,230, 6,642,159, 6,841,492, 6,846,758, all of which are incorporated herein by reference, describe ballistic resistant composites which include high strength fibers made from materials such as extended chain ultra-high molecular weight polyethylene. These composites display varying degrees of resistance to penetration by high speed impact from projectiles such as bullets, shells, shrapnel and the like.

For example, U.S. Pat. Nos. 4,623,574 and 4,748,064 disclose simple composite structures comprising high strength fibers embedded in an elastomeric matrix. U.S. Pat. No. 4,650,710 discloses a flexible article of manufacture comprising a plurality of flexible layers comprised of high strength, extended chain polyolefin (ECP) fibers. The fibers of the network are coated with a low modulus elastomeric material. U.S. Pat. Nos. 5,552,208 and 5,587,230 disclose an article and method for making an article comprising at least one network of high strength fibers and a matrix composition that includes a vinyl ester and diallyl phthalate. U.S. Pat. No. 6,642,159 discloses an impact resistant rigid composite having a plurality of fibrous layers which comprise a network of filaments disposed in a matrix, with elastomeric layers there between. The composite is bonded to a hard plate to increase protection against armor piercing projectiles.

Hard or rigid body armor provides good ballistic resistance, but can be very stiff and bulky. Accordingly, body armor garments, such as ballistic resistant vests, are preferably formed from flexible or soft armor materials. However, while such flexible or soft materials exhibit excellent ballistic resistance properties, they also generally exhibit poor abrasion resistance, which affects durability of the armor. It is desirable in the art to provide soft, flexible ballistic resistant materials having improved durability. The present invention provides a solution to this need.

SUMMARY OF THE INVENTION

The invention provides an abrasion resistant composite comprising at least one fibrous substrate having a multilayer coating thereon, wherein said fibrous substrate comprises one or more fibers having a tenacity of about 7 g/denier or more and a tensile modulus of about 150 g/denier or more; said multilayer coating comprising a layer of a non-silicon-containing material on a surface of said one or more fibers, and a topical layer of a silicon-containing material on the non-silicon-containing material layer.

The invention also provides a method of forming an abrasion resistant composite, comprising:

i) providing at least one coated fibrous substrate having a surface; wherein said at least one fibrous substrate comprises one or more fibers having a tenacity of about 7 g/denier or more and a tensile modulus of about 150 g/denier or more; the surfaces of each of said fibers being substantially coated with a non-silicon-containing material; and ii) applying a silicon-containing material onto at least a portion of said at least one coated fibrous substrate.

The invention further provides a method of forming an abrasion resistant composite, comprising:

i) providing a plurality of non-woven fiber plies, each fiber ply comprising a plurality of fibers having a tenacity of about 7 g/denier or more and a tensile modulus of about 150 g/denier or more; the surfaces of each of said fibers being substantially coated with a non-silicon-containing material;

ii) applying an uncured, silicon-containing coating onto at least a portion of said fiber plies; and iii) subjecting said plurality of non-woven fiber plies and said uncured, silicon-containing coating to conditions sufficient to consolidate said fiber plies into a monolithic fabric composite and optionally cure the silicon-containing coating.

DETAILED DESCRIPTION OF THE INVENTION

The invention presents fibrous composites and articles having superior abrasion resistance and durability. Particularly, the invention provides fibrous composites formed by applying a multilayer coating of the invention onto at least one fibrous substrate. A "fibrous substrate" as used herein may be a single fiber or a fabric, including felt, that has been formed from a plurality of fibers. Preferably, the fibrous substrate is a fabric comprising a plurality of fibers that are united as a monolithic structure, including woven and non-woven fabrics. The coatings of the non-silicon-containing material or both the non-silicon-containing material and the silicon-containing material may be applied onto a plurality of fibers that are arranged as a fiber web or other arrangement, which may or may not be considered to be a fabric at the time of coating. The invention also provides fabrics formed from a plurality of coated fibers, and articles formed from said fabrics.

The fibrous substrates of the invention are coated with a multilayer coating that comprises at least one layer of two different coating materials, wherein a layer of a non-silicon-containing material is applied directly onto a surface of one or more of the fibers and a topical coating of a silicon-containing material is applied on top of the non-silicon-containing material layer.

As used herein, a "silicon-containing" material describes non-polymeric materials and polymers containing silicon atoms, including both cured and uncured silicone-based polymers, as well as low molecular weight, non-polymeric materials. As used herein, "silicone" is defined as a polymeric organic siloxane, specifically organic compounds comprising alternating silicon and oxygen atoms linked to organic radicals, as is well known in the art. Silicone-based materials are derived from silicone. The silicon-containing coating preferably comprises a cured thermoset polymer, a non-reactive thermoplastic polymer or an uncured silicone-based fluid or liquid. Most preferably, the silicon-containing material is not cured, which allows the silicon-containing material to serve as a lubricant, uniformly coating the substrate with a thin layer of the silicon-containing material, and achieving the greatest enhancement in abrasion resistance.

For the purposes of the invention, a liquid polymer includes polymers that are combined with a solvent or other liquid capable of dissolving or dispersing a polymer, molten polymers that are not combined with a solvent or other liquid, as well as uncured fluid polymers. In the preferred embodiments, the silicon-containing material is an uncured silicone-based fluid that is applied as a silicone-based fluid and remains as a silicone-based fluid in the finished product on the surface of the composite fabric. A silicone-based fluid will act as a lubricant for the surface of the composite fabric and improve the abrasion resistance of the composite.

Alternately, a curable liquid silicone-based fluid may be applied to the fibrous substrate and subsequently cured. However, cured or solid silicone polymers, as opposed to uncured silicone fluids, do not normally act as lubricants and may not provide the same abrasion resistance as uncured silicone-based fluids. Other non-silicon-containing lubricants may provide a similar abrasion resistance benefit, but silicone-based materials have low surface energy and are uniquely capable of providing a lubricating effect while substantially remaining on the substrate. A cured silicone-based coating will add another layer of protection to the fibrous substrate, but a cured silicone-based coating itself may be abraded while fluids cannot be abraded. Thus, uncured silicone-based coatings are most preferred.

In the preferred embodiments of the invention, the silicon-containing material comprises an uncured silicone-based fluid or liquid, an uncured silicone-based antifoam, an uncured silicone-based lubricant or an uncured silicone-based release coating. Preferably, the silicone-based fluid comprises a polymeric organic siloxane. Dialkyl silicone fluids, particularly polydimethylsiloxane are preferred, as well as more polar amino-functional, silanol-functional and polyether-functional silicones. Suitable dialkyl silicone fluids are described in, for example, U.S. Pat. No. 4,006,207, the disclosure of which is incorporated herein by reference. Other useful silicone fluids include the DOW CORNING 200® fluids commercially available from Dow Corning of Midland, Mich., preferably their non-reactive silicone fluids, including DOW CORNING 200® (DC200) 10 centistoke (cst) silicone fluid through DC200 1000 cst fluid; Dow Corning silicone release agents, including the DOW CORNING® HV-495 (HV-495) emulsion and the DOW CORNING® 36 emulsion (DC-36); and Dow Corning defoamers/antifoams, such as DOW CORNING® Antifoam 1410 (DC-1410) emulsion. Useful silicone-based fluids also include silicone additives commercially available from Byk-Chemie of Wesel, Germany and the Wacker-Belsil® DM polydimethylsiloxane fluids commercially available from Wacker Chemical Corp. of Adrian, Mich. Also useful are silicone release agents from Wacker Chemical Corp such as Wacker Silicone Release Agent TN and WACKER® TNE 50. Also useful are liquid silicone polymers described in U.S. Pat. Nos. 4,780,338 and 4,929,691, the disclosures of which are incorporated herein by reference. Useful silicone antifoams are described in, for example, U.S. Pat. Nos. 5,153,258, 5,262,088, the disclosures of which are incorporated herein by reference.

Preferably the silicon-containing material comprises a silicone-based fluid having a weight average molecular weight of from about 200 g/mol to about 250,000 g/mol, more preferably from about 500 g/mol to about 80,000 g/mol, more preferably from about 1000 g/mol to about 40,000 g/mol and most preferably from about 2000 g/mol to about 20,000 g/mol. Lower molecular weight silicon-containing materials may not be considered polymers, but polymeric silicon-containing materials are preferred for the silicon-containing material layer. Preferably the silicon-containing material comprises a silicone-based fluid having a viscosity of from about 1 cst to about 100,000 cst at 25° C., more preferably from about 10 cst to about 10,000 cst and most preferably from about 10 cst to about 1000 cst at 25° C. The most preferred silicone-based fluids will have a viscosity of from about 10 cst to about 1000 cst at 25° C. with a corresponding weight average molecular weight of from about 1000 g/mol to about 20,000 g/mol). These preferences are not intended to be limiting, and silicone-based liquids having higher/lower molecular weights and higher/lower viscosities may also be utilized.

The coated fibrous substrates of the invention are particularly intended for the production of fabrics and articles having superior ballistic penetration resistance. For the purposes of the invention, articles that have superior ballistic penetration resistance describe those which exhibit excellent properties against deformable projectiles and against penetration of fragments, such as shrapnel. For the purposes of the present invention, a "fiber" is an elongate body the length dimension of which is much greater than the transverse dimensions of width and thickness. The cross-sections of fibers for use in this invention may vary widely. They may be circular, flat or oblong in cross-section. Accordingly, the term fiber includes filaments, ribbons, strips and the like having regular or irregular cross-section. They may also be of irregular or regular multi-lobal cross-section having one or more regular or irregular lobes projecting from the linear or longitudinal axis of the fibers. It is preferred that the fibers are single lobed and have a substantially circular cross-section.

As stated above, the multilayer coatings may be applied onto a single polymeric fiber or a plurality of polymeric fibers. A plurality of fibers may be present in the form of a fiber web, a woven fabric, a non-woven fabric or a yarn, where a yarn is defined herein as a strand consisting of multiple fibers and where a fabric comprises a plurality of united fibers. In embodiments including a plurality of fibers, the multilayer coatings may be applied either before the fibers are arranged into a fabric or yarn, or after the fibers are arranged into a fabric or yarn.

The fibers of the invention may comprise any polymeric fiber type. Most preferably, the fibers comprise high strength, high tensile modulus fibers which are useful for the formation of ballistic resistant materials and articles. As used herein, a "high-strength, high tensile modulus fiber" is one which has a preferred tenacity of at least about 7 g/denier or more, a preferred tensile modulus of at least about 150 g/denier or more, and preferably an energy-to-break of at least about 8 J/g or more, each both as measured by ASTM D2256. As used herein, the term "denier" refers to the unit of linear density, equal to the mass in grams per 9000 meters of fiber or yarn. As used herein, the term "tenacity" refers to the tensile stress expressed as force (grams) per unit linear density (denier) of an unstressed specimen. The "initial modulus" of a fiber is the property of a material representative of its resistance to deformation. The term "tensile modulus" refers to the ratio of the change in tenacity, expressed in grams-force per denier (g/d) to the change in strain, expressed as a fraction of the original fiber length (in/in).

The polymers forming the fibers are preferably high-strength, high tensile modulus fibers suitable for the manufacture of ballistic resistant fabrics. Particularly suitable high-strength, high tensile modulus fiber materials that are particularly suitable for the formation of ballistic resistant materials and articles include polyolefin fibers including high density and low density polyethylene. Particularly preferred are extended chain polyolefin fibers, such as highly oriented, high molecular weight polyethylene fibers, particularly ultra-high molecular weight polyethylene fibers, and polypropylene fibers, particularly ultra-high molecular weight polypropylene fibers. Also suitable are aramid fibers, particularly para-aramid fibers, polyamide fibers, polyethylene terephthalate fibers, polyethylene naphthalate fibers, extended chain polyvinyl alcohol fibers, extended chain polyacrylonitrile fibers, polybenzazole fibers, such as polybenzoxazole (PBO) and polybenzothiazole (PBT) fibers, liquid crystal copolyester fibers and rigid rod fibers such as M5® fibers. Each of these fiber types is conventionally known in the art. Also suitable for producing polymeric fibers are copolymers, block polymers and blends of the above materials.

The most preferred fiber types for ballistic resistant fabrics include polyethylene, particularly extended chain polyethylene fibers, aramid fibers, polybenzazole fibers, liquid crystal copolyester fibers, polypropylene fibers, particularly highly oriented extended chain polypropylene fibers, polyvinyl alcohol fibers, polyacrylonitrile fibers and rigid rod fibers, particularly M5® fibers.

In the case of polyethylene, preferred fibers are extended chain polyethylenes having molecular weights of at least 500,000, preferably at least one million and more preferably between two million and five million. Such extended chain polyethylene (ECPE) fibers may be grown in solution spinning processes such as described in U.S. Pat. No. 4,137,394 or 4,356,138, which are incorporated herein by reference, or may be spun from a solution to form a gel structure, such as described in U.S. Pat. Nos. 4,551,296 and 5,006,390, which are also incorporated herein by reference. A particularly preferred fiber type for use in the invention are polyethylene fibers sold under the trademark SPECTRA® from Honeywell International Inc. SPECTRA® fibers are well known in the art and are described, for example, in U.S. Pat. Nos. 4,623,547 and 4,748,064.

Also particularly preferred are aramid (aromatic polyamide) or para-aramid fibers. Such are commercially available and are described, for example, in U.S. Pat. No. 3,671,542. For example, useful poly(p-phenylene terephthalamide) filaments are produced commercially by Dupont corporation under the trademark of KEVLAR®. Also useful in the practice of this invention are poly(m-phenylene isophthalamide) fibers produced commercially by Dupont under the trademark NOMEX® and fibers produced commercially by Teijin under the trademark TWARON®; aramid fibers produced commercially by Kolon Industries, Inc. of Korea under the trademark HERACRON®; p-aramid fibers SVM™ and RUSAR™ which are produced commercially by Kamensk Volokno JSC of Russia and ARMOS™ p-aramid fibers produced commercially by JSC Chim Volokno of Russia.

Suitable polybenzazole fibers for the practice of this invention are commercially available and are disclosed for example in U.S. Pat. Nos. 5,286,833, 5,296,185, 5,356,584, 5,534,205 and 6,040,050, each of which are incorporated herein by reference. Suitable liquid crystal copolyester fibers for the practice of this invention are commercially available and are disclosed, for example, in U.S. Pat. Nos. 3,975,487; 4,118,372 and 4,161,470, each of which is incorporated herein by reference.

Suitable polypropylene fibers include highly oriented extended chain polypropylene (ECPP) fibers as described in U.S. Pat. No. 4,413,110, which is incorporated herein by reference. Suitable polyvinyl alcohol (PV-OH) fibers are described, for example, in U.S. Pat. Nos. 4,440,711 and 4,599,267 which are incorporated herein by reference. Suitable polyacrylonitrile (PAN) fibers are disclosed, for example, in U.S. Pat. No. 4,535,027, which is incorporated herein by reference. Each of these fiber types is conventionally known and is widely commercially available.

The other suitable fiber types for use in the present invention include rigid rod fibers such as M5® fibers, and combinations of all the above materials, all of which are commercially available. For example, the fibrous layers may be formed from a combination of SPECTRA® fibers and Kevlar® fibers. M5® fibers are formed from pyridobisimidazole-2,6-diyl (2,5-dihydroxy-p-phenylene) and are manufactured by Magellan Systems International of Richmond, Va. and are described, for example, in U.S. Pat. Nos. 5,674,969, 5,939,553, 5,945,537, and 6,040,478, each of which is incorporated herein by reference. Specifically preferred fibers include M5® fibers, polyethylene SPECTRA® fibers, aramid Kevlar® fibers and aramid TWARON® fibers. The fibers may be of any suitable denier, such as, for example, 50 to about 3000 denier, more preferably from about 200 to 3000 denier, still more preferably from about 650 to about 2000 denier, and most preferably from about 800 to about 1500 denier. The selection is governed by considerations of ballistic effectiveness and cost. Finer fibers are more costly to manufacture and to weave, but can produce greater ballistic effectiveness per unit weight.

The most preferred fibers for the purposes of the invention are either high-strength, high tensile modulus extended chain polyethylene fibers or high-strength, high tensile modulus para-aramid fibers. As stated above, a high-strength, high tensile modulus fiber is one which has a preferred tenacity of about 7 g/denier or more, a preferred tensile modulus of about 150 g/denier or more and a preferred energy-to-break of about 8 J/g or more, each as measured by ASTM D2256. In the preferred embodiment of the invention, the tenacity of the fibers should be about 15 g/denier or more, preferably about 20 g/denier or more, more preferably about 25 g/denier or more and most preferably about 30 g/denier or more. The fibers of the invention also have a preferred tensile modulus of about 300 g/denier or more, more preferably about 400 g/denier or more, more preferably about 500 g/denier or more, more preferably about 1,000 g/denier or more and most preferably about 1,500 g/denier or more. The fibers of the invention also have a preferred energy-to-break of about 15 J/g or more, more preferably about 25 J/g or more, more preferably about 30 J/g or more and most preferably have an energy-to-break of about 40 J/g or more.

These combined high strength properties are obtainable by employing well known processes. U.S. Pat. Nos. 4,413,110, 4,440,711, 4,535,027, 4,457,985, 4,623,547 4,650,710 and 4,748,064 generally discuss the formation of preferred high strength, extended chain polyethylene fibers employed in the present invention. Such methods, including solution grown or gel fiber processes, are well known in the art. Methods of forming each of the other preferred fiber types, including para-aramid fibers, are also conventionally known in the art, and the fibers are commercially available.

The silicon-containing material is applied onto a fibrous substrate that has already been coated with a non-silicon-containing material, also known in the art as a polymeric matrix or polymeric binder material. Accordingly, the fibrous substrates of the invention are coated with multilayer coatings comprising a layer of a non-silicon-containing material on a surface of said one or more fibers, and a topical layer of a silicon-containing material on the non-silicon-containing material layer.

The non-silicon-containing material layer preferably comprises at least one material that is conventionally used in the art as a polymeric binder or matrix material, binding a plurality of fibers together by way of its inherent adhesive characteristics or after being subjected to well known heat and/or pressure conditions. Such include both low modulus, elastomeric materials and high modulus, rigid materials. Preferred low modulus, elastomeric materials are those having an initial tensile modulus less than about 6,000 psi (41.3 MPa) as measured at 37° C. by ASTM D638. Preferred high modulus, rigid materials generally have a higher initial tensile modulus. As used herein throughout, the term tensile modulus means the modulus of elasticity as measured by ASTM 2256 for a fiber and by ASTM D638 for a polymeric binder material. Generally, a polymeric binder coating is necessary to efficiently merge, i.e. consolidate, a plurality of non-woven fiber plies. The non-silicon-containing material may be applied onto the entire surface area of the individual fibers, or only onto a partial surface area of the fibers. Most preferably, the coating of the non-silicon-containing material is applied onto substantially all the surface area of each individual fiber forming a woven or non-woven fabric of the invention. Where the fabrics comprise a plurality of yarns, each fiber forming a single strand of yarn is preferably coated with the non-silicon-containing material.

An elastomeric polymeric binder (non-silicon-containing material) may comprise a variety of materials. A preferred elastomeric binder material comprises a low modulus elastomeric material. For the purposes of this invention, a low modulus elastomeric material has a tensile modulus, measured at about 6,000 psi (41.4 MPa) or less according to ASTM D638 testing procedures. Preferably, the tensile modulus of the elastomer is about 4,000 psi (27.6 MPa) or less, more preferably about 2400 psi (16.5 MPa) or less, more preferably 1200 psi (8.23 MPa) or less, and most preferably is about 500 psi (3.45 MPa) or less. The glass transition temperature (Tg) of the elastomer is preferably about 0° C. or less, more preferably about −40° C. or less, and most preferably about −50° C. or less. The elastomer also has a preferred elongation to break of at least about 50%, more preferably at least about 100% and most preferably has an elongation to break of at least about 300%.

A wide variety of materials and formulations having a low modulus may be utilized for the non-silicon-containing coating. Representative examples include polybutadiene, polyisoprene, natural rubber, ethylene-propylene copolymers, ethylene-propylene-diene terpolymers, polysulfide polymers, polyurethane elastomers, chlorosulfonated polyethylene, polychloroprene, plasticized polyvinylchloride, butadiene acrylonitrile elastomers, poly(isobutylene-co-isoprene), polyacrylates, polyesters, polyethers, copolymers of ethylene, and combinations thereof, and other low modulus polymers and copolymers. Also preferred are blends of different elastomeric materials, or blends of elastomeric materials with one or more thermoplastics.

Particularly useful are block copolymers of conjugated dienes and vinyl aromatic monomers. Butadiene and isoprene are preferred conjugated diene elastomers. Styrene, vinyl toluene and t-butyl styrene are preferred conjugated aromatic monomers. Block copolymers incorporating polyisoprene may be hydrogenated to produce thermoplastic elastomers having saturated hydrocarbon elastomer segments. The polymers may be simple tri-block copolymers of the type A-B-A, multi-block copolymers of the type $(AB)_n$(n=2-10) or radial configuration copolymers of the type R-$(BA)_x$(x=3-150); wherein A is a block from a polyvinyl aromatic monomer and B is a block from a conjugated diene elastomer. Many of these polymers are produced commercially by Kraton Polymers of Houston, Tex. and described in the bulletin "Kraton Thermoplastic Rubber", SC-68-81. The most preferred low modulus polymeric binder materials comprise styrenic block copolymers, particularly polystyrene-polyisoprene-polystrene-block copolymers, sold under the trademark KRATON® commercially produced by Kraton Polymers and HYCAR® acrylic polymers commercially available from Noveon, Inc. of Cleveland, Ohio.

Preferred high modulus, rigid polymers useful for the non-silicon-containing material include polymers such as a vinyl ester polymer or a styrene-butadiene block copolymer, and also mixtures of polymers such as vinyl ester and diallyl phthalate or phenol formaldehyde and polyvinyl butyral. A particularly preferred high modulus material is a thermosetting polymer, preferably soluble in carbon-carbon saturated solvents such as methyl ethyl ketone, and possessing a high tensile modulus when cured of at least about $1\times10^5$ psi (689.5 MPa) as measured by ASTM D638. Particularly preferred rigid materials are those described in U.S. Pat. No. 6,642,159, which is incorporated herein by reference. In the preferred embodiments of the invention, either the non-silicon-containing material layer comprises a polyurethane polymer, a polyether polymer, a polyester polymer, a polycarbonate polymer, a polyacetal polymer, a polyamide polymer, a polybutylene polymer, an ethylene-vinyl acetate copolymer, an ethylene-vinyl alcohol copolymer, an ionomer, a styrene-isoprene copolymer, a styrene-butadiene copolymer, a styrene-ethylene/butylene copolymer, a styrene-ethylene/propylene copolymer, a polymethyl pentene polymer, a hydrogenated styrene-ethylene/butylene copolymer, a maleic anhydride functionalized styrene-ethylene/butylene copolymer, a carboxylic acid functionalized styrene-ethylene/butylene copolymer, an acrylonitrile polymer, an acrylonitrile butadiene styrene copolymer, a polypropylene polymer, a polypropylene copolymer, an epoxy polymer, a novolac polymer, a phenolic polymer, a vinyl ester polymer, a nitrile rubber polymer, a natural rubber polymer, a cellulose acetate butyrate polymer, a polyvinyl butyral polymer, an acrylic polymer, an acrylic copolymer or an acrylic copolymer incorporating non-acrylic monomers.

The rigidity, impact and ballistic properties of the articles formed from the fibrous composites of the invention are affected by the tensile modulus of the binder polymers coating the fibers. For example, U.S. Pat. No. 4,623,574 discloses that fiber reinforced composites constructed with elastomeric matrices having tensile moduli less than about 6000 psi (41,300 kPa) have superior ballistic properties compared both to composites constructed with higher modulus polymers, and also compared to the same fiber structure without one or more coatings of a polymeric binder material. However, low tensile modulus polymeric binder polymers also yield lower rigidity composites. Further, in certain applications, particularly those where a composite must function in both anti-ballistic and structural modes, there is needed a superior combination of ballistic resistance and rigidity. Accordingly, the most appropriate type of non-silicon-containing material to be used will vary depending on the type of article to be formed from the fabrics of the invention. In order to achieve a compromise in both properties, a suitable non-silicon-containing material may also comprise a combination of both low modulus and high modulus materials. Each polymer layer may also include fillers such as carbon black or silica, may be extended with oils, or may be vulcanized by sulfur, peroxide, metal oxide or radiation cure systems if appropriate, as is well known in the art.

To produce a fabric article having sufficient ballistic resistance properties, the proportion of fibers forming the fabric preferably comprises from about 50% to about 98% by weight of the fibers plus the weight of the combined coatings, more preferably from about 70% to about 95%, and most preferably from about 78% to about 90% by weight of the fibers plus the coatings. Thus, the total weight of the combined coatings preferably comprises from about 1% to about 50% by weight, more preferably from about 2% to about 30%, more preferably from about 10% to about 22% and most preferably from about 14% to about 17% by weight of the fibers plus the weight of the combined coatings, wherein 16% is most preferred for non-woven fabrics. A lower binder/matrix content is appropriate for woven fabrics, wherein a binder content of greater than zero but less than 10% by weight of the fibers plus the weight of the combined coatings is most preferred. The weight of the topical silicon-containing coating is preferably from about 0.01% to about 5.0% by weight, more preferably from about 0.1% to about 3.0% and most preferably from about 0.2% to about 1.5% by weight of the fibers plus the weight of the combined coatings.

When forming non-woven fabrics, the non-silicon-containing coating is preferably first applied to a plurality of fibers, where the fibers are thereby coated on, impregnated with, embedded in, or otherwise applied with the coating. The fibers are arranged into one or more fiber plies and the plies are then consolidated following conventional techniques. In another technique, fibers are coated, randomly arranged and consolidated to form a felt. When forming woven fabrics, the fibers may be coated with the non-silicon-containing coating either prior to or after weaving, preferably after. Such techniques are well known in the art. Articles of the invention may also comprise combinations of woven fabrics, non-woven fabrics formed from unidirectional fiber plies and non-woven felt fabrics.

Thereafter, the topical coating of the silicon-containing material is applied onto at least one surface of the consolidated fabric onto the non-silicon-containing material layer. Preferably, both outer surfaces of the fabric are coated with the silicon-containing material to improve overall fabric durability, but coating just one side of the fabric with the silicon-containing material will provide improved abrasion resistance and add less weight. The multilayer coating is preferably applied on top of any pre-existing fiber finish, such as a spin finish, or a pre-existing fiber finish may be at least partially removed prior to applying the coatings. The silicon-containing material need only be on one or both exterior surfaces of the composite fabric, and the individual fibers need not be coated therewith.

For the purposes of the present invention, the term "coated" is not intended to limit the method by which the polymer layers are applied onto the fibrous substrate surface. Any appropriate application method may be utilized where the non-silicon-containing material layer is applied first directly onto the fiber surfaces, followed by subsequently applying the silicon-containing material layer onto the non-silicon-containing material layer.

For example, the non-silicon-containing layer may be applied in solution form by spraying or roll coating a solution of the polymeric material onto fiber surfaces, wherein a portion of the solution comprises the desired polymer or polymers and a portion of the solution comprises a solvent capable of dissolving the polymer or polymers, followed by drying. Another method is to apply a neat polymer of the non-silicon-containing material(s) to the fibers either as a liquid, a sticky solid or particles in suspension or as a fluidized bed. Alternatively, the non-silicon-containing material may be applied as a solution, emulsion or dispersion in a suitable solvent which does not adversely affect the properties of fibers at the temperature of application. For example, fibers may be transported through a solution of the polymeric binder material and substantially coated with a non-silicon-containing material and then dried to form a coated fibrous substrate. The resulting coated fibers are then arranged into the desired configuration and thereafter coated with the silicon-containing material. In another coating technique, unidirectional fiber plies or woven fabrics may first be arranged, followed by dipping the plies or fabrics into a bath of a solution containing the non-silicon-containing material dissolved in a suitable solvent, such that each individual fiber is at least partially coated with the polymer, and then dried through evaporation or volatilization of the solvent, and subsequently the silicon-containing material layer may be applied via the same method. The dipping procedure may be repeated several times as required to place a desired amount of each polymeric coating onto the fibers, preferably substantially coating or encapsulating each of the individual fibers and covering all or substantially all of the fiber surface area with the non-silicon-containing material. The silicon-containing material may also be applied such that it covers all or substantially all of the non-silicon-containing material layer on the fibers. In the preferred embodiments of the invention, the topical coating of the silicon-containing material is only partially applied onto the coated fibers or coated fabric, i.e. it is only necessary to coat the outside surfaces of the fabric.

Other techniques for applying the non-silicon-containing coating to the fibers may be used, including coating of the high modulus precursor (gel fiber) before the fibers are subjected to a high temperature stretching operation, either before or after removal of the solvent from the fiber (if using a gel-spinning fiber forming technique). The fiber may then be stretched at elevated temperatures to produce the coated fibers. The gel fiber may be passed through a solution of the appropriate coating polymer under conditions to attain the desired coating.

Crystallization of the high molecular weight polymer in the gel fiber may or may not have taken place before the fiber passes into the solution. Alternatively, the fibers may be extruded into a fluidized bed of an appropriate polymeric powder. Furthermore, if a stretching operation or other manipulative process, e.g. solvent exchanging, drying or the like is conducted, the non-silicon-containing material may be applied to a precursor material of the final fibers.

The silicon-containing material is applied to the fibrous substrate atop the non-silicon-containing material in the liquid state. In one embodiment of the invention, the silicon-containing material is applied as an uncured liquid while the non-silicon-containing material is also in the liquid state or when in the solid state. Most preferably, the silicon-containing material is applied as an uncured liquid onto a cured or otherwise solidified non-silicon-containing material. Subsequently, the uncured liquid may optionally be cured via conventional techniques, but curing is not preferred for optimal abrasion resistance.

The coated fibers may be formed into non-woven fabrics which comprise a plurality of overlapping, non-woven fibrous plies that are consolidated into a single-layer, monolithic element. Most preferably, each ply comprises an arrangement of non-overlapping fibers that are aligned in a unidirectional, substantially parallel array. This type of fiber arrangement is known in the art as a "unitape" (unidirectional tape) and is referred to herein as a "single ply". As used herein, an "array" describes an orderly arrangement of fibers or yarns, and a "parallel array" describes an orderly parallel arrangement of fibers or yarns. A fiber "layer" describes a planar arrangement of woven or non-woven fibers or yarns including one or more plies. As used herein, a "single-layer" structure refers to monolithic structure composed of one or more individual fiber plies that have been consolidated into a single unitary structure. By "consolidating" it is meant that the polymeric binder coating together with each fiber ply are combined into a single unitary layer. Consolidation can occur via drying, cooling, heating, pressure or a combination thereof. Heat and/or pressure may not be necessary, as the fibers or fabric layers may just be glued together, as is the case in a wet lamination process. The term "composite" refers to combinations of fibers with the one or both of the coatings and an abrasion resistant composite will include the silicon-containing coating. Such is conventionally known in the art.

A preferred non-woven fabric of the invention includes a plurality of stacked, overlapping fiber plies (plurality of unitapes) wherein the parallel fibers of each single ply (unitape) are positioned orthogonally (0°/90°) to the parallel fibers of each adjacent single ply relative to the longitudinal fiber direction of each single ply. The stack of overlapping non-woven fiber plies is consolidated under heat and pressure, or by adhering the coatings of individual fiber plies, to form a single-layer, monolithic element which has also been referred to in the art as a single-layer, consolidated network where a "consolidated network" describes a consolidated (merged) combination of fiber plies with a polymeric binder/matrix. The terms "polymeric binder" and "polymeric matrix" are used interchangeably herein, and describe a material that binds fibers together. These terms are conventionally known in the art. For the purposes of this invention, where the fibrous substrate is a non-woven, consolidated fabric formed as a single-layer, consolidated network, the fibers are coated with the non-silicon-containing polymer coating but only the outside surface of the monolithic fabric structure is coated with the silicon-containing coating to provide the desired abrasion resistance, not each of the component fiber plies.

As is conventionally known in the art, excellent ballistic resistance is achieved when individual fiber plies are cross-plied such that the fiber alignment direction of one ply is rotated at an angle with respect to the fiber alignment direction of another ply. Most preferably, the fiber plies are cross-plied orthogonally at 0° and 90° angles, but adjacent plies can be aligned at virtually any angle between about 0° and about 90° with respect to the longitudinal fiber direction of another ply. For example, a five ply non-woven structure may have plies oriented at a 0°/45°/90°/45°/0° or at other angles. Such rotated unidirectional alignments are described, for example, in U.S. Pat. Nos. 4,457,985; 4,748,064; 4,916,000; 4,403,012; 4,623,573; and 4,737,402.

Most typically, non-woven fabrics include from 1 to about 6 plies, but may include as many as about 10 to about 20 plies as may be desired for various applications. The greater the number of plies translates into greater ballistic resistance, but also greater weight. Accordingly, the number of fiber plies forming a fabric or an article of the invention varies depending upon the ultimate use of the fabric or article. For example, in body armor vests for military applications, in order to form an article composite that achieves a desired 1.0 pound per square foot areal density (4.9 kg/m$^2$), a total of about 20 plies (or layers) to about 60 individual plies (or layers) may be required, wherein the plies/layers may be woven, knitted, felted or non-woven fabrics (with parallel oriented fibers or other arrangements) formed from the high-strength fibers described herein. In another embodiment, body armor vests for law enforcement use may have a number of plies/layers based on the National Institute of Justice (NIJ) Threat Level. For example, for an NIJ Threat Level IIIA vest, there may be a total of 22 plies/layers. For a lower NIJ Threat Level, fewer plies/layers may be employed.

Consolidated non-woven fabrics may be constructed using well known methods, such as by the methods described in U.S. Pat. No. 6,642,159, the disclosure of which is incorporated herein by reference. As is well known in the art, consolidation is done by positioning the individual fiber plies on one another under conditions of sufficient heat and pressure to cause the plies to combine into a unitary fabric. Consolidation may be done at temperatures ranging from about 50° C. to about 175° C., preferably from about 105° C. to about 175° C., and at pressures ranging from about 5 psig (0.034 MPa) to about 2500 psig (17 MPa), for from about 0.01 seconds to about 24 hours, preferably from about 0.02 seconds to about 2 hours. When heating, it is possible that the non-silicon-containing polymeric binder coatings can be caused to stick or flow without completely melting. However, generally, if the polymeric binder materials are caused to melt, relatively little pressure is required to form the composite, while if the binder materials are only heated to a sticking point, more pressure is typically required. As is conventionally known in the art, consolidation may be conducted in a calender set, a flat-bed laminator, a press or in an autoclave.

Alternately, consolidation may be achieved by molding under heat and pressure in a suitable molding apparatus. Generally, molding is conducted at a pressure of from about 50 psi (344.7 kPa) to about 5000 psi (34470 kPa), more preferably about 100 psi (689.5 kPa) to about 1500 psi (10340 kPa), most preferably from about 150 psi (1034 kPa) to about 1000 psi (6895 kPa). Molding may alternately be conducted at higher pressures of from about 500 psi (3447 kPa) to about 5000 psi, more preferably from about 750 psi (5171 kPa) to about 5000 psi and more preferably from about 1000 psi to about 5000 psi. The molding step may take from about 4 seconds to about 45 minutes. Preferred molding temperatures range from about 200° F. (~93° C.) to about 350° F. (~177° C.), more preferably at a temperature from about 200° F. to about 300° F. (~149° C.) and most preferably at a temperature from about 200° F. to about 280° F. (~121° C.). The pressure under which the fabrics of the invention are molded has a direct effect on the stiffness or flexibility of the resulting molded product. Particularly, the higher the pressure at which the fabrics are molded, the higher the stiffness, and vice-versa. In addition to the molding pressure, the quantity, thickness and composition of the fabric plies and polymeric binder coating types also directly affects the stiffness of the articles formed from the inventive fabrics. Most commonly, a plurality of orthogonal fiber webs are "glued" together with the matrix polymer and run through a flat bed laminator to improve the uniformity and strength of the bond.

While each of the molding and consolidation techniques described herein are similar, each process is different. Particularly, molding is a batch process and consolidation is a continuous process. Further, molding typically involves the use of a mold, such as a shaped mold or a match-die mold when forming a flat panel, and does not necessarily result in a planar product. Normally consolidation is done in a flat-bed laminator, a calendar nip set or as a wet lamination to produce soft (flexible) body armor fabrics. Molding is typically reserved for the manufacture of hard armor, e.g. rigid plates. In the context of the present invention, consolidation techniques and the formation of soft body armor are preferred.

In either process, suitable temperatures, pressures and times are generally dependent on the type of non-silicon-containing polymeric binder coating materials, polymeric binder content (of the combined coatings), process used and fiber type. The fabrics of the invention may optionally be calendered under heat and pressure to smooth or polish their surfaces. Calendering methods are well known in the art.

Woven fabrics may be formed using techniques that are well known in the art using any fabric weave, such as plain weave, crowfoot weave, basket weave, satin weave, twill weave and the like. Plain weave is most common, where fibers are woven together in an orthogonal 0°/90° orientation. In another embodiment, a hybrid structure may be assembled where one both woven and non-woven fabrics are combined and interconnected, such as by consolidation. Prior to weaving, the individual fibers of each woven fabric material may or may not be coated with the non-silicon-containing material layer. The silicon-containing material layer is most preferably coated onto the woven fabric.

The thickness of the individual fabrics will correspond to the thickness of the individual fibers. A preferred woven fabric will have a preferred thickness of from about 25 μm to about 500 μm per layer, more preferably from about 50 μm to about 385 μm and most preferably from about 75 μm to about 255 μm per layer. A preferred non-woven fabric, i.e. a non-woven, single-layer, consolidated network, will have a preferred thickness of from about 12 μm to about 500 μm, more preferably from about 50 μm to about 385 μm and most preferably from about 75 μm to about 255 μm, wherein a single-layer, consolidated network typically includes two consolidated plies (i.e. two unitapes). While such thicknesses are preferred, it is to be understood that other thicknesses may be produced to satisfy a particular need and yet fall within the scope of the present invention.

The fabrics of the invention will have a preferred areal density of from about 50 grams/$m^2$ (gsm) (0.01 lb/$ft^2$ (psf)) to about 1000 gsm (0.2 psf). More preferable areal densities for the fabrics of this invention will range from about 70 gsm (0.014 psf) to about 500 gsm (0.1 psf). The most preferred areal density for fabrics of this invention will range from about 100 gsm (0.02 psf) to about 250 gsm (0.05 psf). The articles of the invention, which comprise multiple individual layers of fabric stacked one upon the other, will further have a preferred areal density of from about 1000 gsm (0.2 psf) to about 40,000 gsm (8.0 psf), more preferably from about 2000 gsm (0.40 psf) to about 30,000 gsm (6.0 psf), more preferably from about 3000 gsm (0.60 psf) to about 20,000 gsm (4.0 psf), and most preferably from about 3750 gsm (0.75 psf) to about 10,000 gsm (2.0 psf).

The composites of the invention may be used in various applications to form a variety of different ballistic resistant articles using well known techniques. For example, suitable techniques for forming ballistic resistant articles are described in, for example, U.S. Pat. Nos. 4,623,574, 4,650,710, 4,748,064, 5,552,208, 5,587,230, 6,642,159, 6,841,492 and 6,846,758. The composites are particularly useful for the formation of flexible, soft armor articles, including garments such as vests, pants, hats, or other articles of clothing, and covers or blankets, used by military personnel to defeat a number of ballistic threats, such as 9 mm full metal jacket (FMJ) bullets and a variety of fragments generated due to explosion of hand-grenades, artillery shells, Improvised Explosive Devices (IED) and other such devises encountered in a military and peace keeping missions.

As used herein, "soft" or "flexible" armor is armor that does not retain its shape when subjected to a significant amount of stress. The structures are also useful for the formation of rigid, hard armor articles. By "hard" armor is meant an article, such as helmets, panels for military vehicles, or protective shields, which have sufficient mechanical strength so that it maintains structural rigidity when subjected to a significant amount of stress and is capable of being freestanding without collapsing. The structures can be cut into a plurality of discrete sheets and stacked for formation into an article or they can be formed into a precursor which is subsequently used to form an article. Such techniques are well known in the art.

Garments of the invention may be formed through methods conventionally known in the art. Preferably, a garment may be formed by adjoining the ballistic resistant articles of the invention with an article of clothing. For example, a vest may comprise a generic fabric vest that is adjoined with the ballistic resistant structures of the invention, whereby the inventive structures are inserted into strategically placed pockets. This allows for the maximization of ballistic protection, while minimizing the weight of the vest. As used herein, the terms "adjoining" or "adjoined" are intended to include attaching, such as by sewing or adhering and the like, as well as unattached coupling or juxtaposition with another fabric, such that the ballistic resistant articles may optionally be easily removable from the vest or other article of clothing. Articles used in forming flexible structures like flexible sheets, vests and other garments are preferably formed from using a low tensile modulus binder material. Hard articles like helmets and armor are preferably, but not exclusively, formed using a high tensile modulus binder material.

Ballistic resistance properties are determined using standard testing procedures that are well known in the art. Particularly, the protective power or penetration resistance of a ballistic resistant composite is normally expressed by citing the impacting velocity at which 50% of the projectiles penetrate the composite while 50% are stopped by the composite, also known as the $V_{50}$ value. As used herein, the "penetration resistance" of an article is the resistance to penetration by a designated threat, such as physical objects including bullets, fragments, shrapnel and the like. For composites of equal areal density, which is the weight of the composite divided by its area, the higher the $V_{50}$, the better the ballistic resistance of the composite. The ballistic resistant properties of the articles of the invention will vary depending on many factors, particularly the type of fibers used to manufacture the fabrics, the percent by weight of the fibers in the composite, the suitability of the physical properties of the coating materials, the number of layers of fabric making up the composite and the total areal density of the composite.

The following examples serve to illustrate the invention:

EXAMPLES

Various fabric samples were tested as exemplified below. Each sample comprised 1000-denier TWARON® type 2000 aramid fibers and a non-silicon-containing polymeric binder material and included 45 fiber layers. For Samples A1-A4, the non-silicon-containing coating is an unmodified, water-based polyurethane polymer. For Samples B1-B4, the non-silicon-containing coating is a fluorocarbon-modified, water-based acrylic polymer (84.5 wt. % acrylic copolymer sold as HYCAR® 26-1199, commercially available from Noveon, Inc. of Cleveland, Ohio; 15 wt. % NUVA® NT X490 fluorocarbon resin, commercially available from Clariant International, Ltd. of Switzerland; and 0.5% Dow TERGITOL® TMN-3 non-ionic surfactant commercially available from Dow Chemical Company of Midland, Mich.). For Samples C1-C4, the non-silicon-containing coating is a fluoropolymer/nitrile rubber blend (84.5 wt. % nitrile rubber polymer sold as TYLAC®68073 from Dow Reichhold of North Carolina; 15 wt. % NUVA® TTH U fluorocarbon resin; and 0.5% Dow TERGITOL® TMN-3 non-ionic surfactant). For Samples D1-D7, the non-silicon-containing coating is a fluoropolymer/acrylic blend (84.5 wt. % acrylic polymer sold as HYCAR 26477 from Noveon Inc. of Cleveland, Ohio; 15 wt. % NUVA NT X490 fluorocarbon resin; and 0.5% Dow TERGITOL TMN-3 nonionic surfactant). For Samples E1-E8, the non-silicon-containing binder material is a fluorocarbon-modified polyurethane polymer (84.5 wt. % polyurethane polymer sold as SANCURE® 20025, from Noveon, Inc.; 15 wt. % NUVA® NT X490 fluorocarbon resin; and 0.5% Dow TERGITOL® TMN-3 non-ionic surfactant).

Each of the fabric samples were non-woven, consolidated fabrics with a two-ply (two unitape), 0°/90 construction. The fabrics had an areal weight and Total Areal Density (TAD) (areal density of fabrics including the fibers and the polymeric binder material) as shown in Table 2. The fiber content of each fabric was approximately 85%, with the balance of 15% being the identified non-silicon-containing polymeric binder material.

Samples A2, B2, C2, D3, D6, E3 and E6 were coated with R300B silicone belt release fluid (estimated 250 cst), commercially available from Reliant Machinery, Ltd., of Bedfordshire, UK, in a flatbed laminator, which consisted of 0.7% of the weight of the sample. Samples D2, D5, E2, E5, A4, B4 and C4 were coated with 1000 cst DOW CORNING 200® silicone fluid in a flatbed laminator, which consisted of 2.5% of the weight of the sample. Samples A3, B3, C3, D4 and E4 were run through the flatbed laminator dry without a silicone coating to determine the effect, if any, of the processing. Samples A1, B1, C1, D1, D7, E1, E7 and E8 are control samples with no topical silicone coating and no processing through the laminator. Sample A4 was equivalent to sample A2 but was coated with 1000 cst DOW CORNING 200® silicone fluid (2.5% by weight) instead of R300B fluid. Sample B4 was equivalent to sample B2 but was coated with 1000 cst DOW CORNING 200® silicone fluid (2.5% by weight) instead of R300B fluid. Sample C4 was equivalent to sample C2 but was coated with 1000 cst DOW CORNING 200® silicone fluid (2.5% by weight) instead of R300B fluid.

Examples 1-15

Each of the five fabric types described above were tested for abrasion resistance per the ASTM D3886 Inflated Diaphragm testing method. The fabrics tested for each sample type were the control samples which were not coated with the silicon-based coating, as well as the samples coated with ~2500 cst R300B fluid and 1000 cst DC200 fluid. The results are quantified as Pass or Fail based on the OTV requirement of "no broken surface characteristics" after 2000 cycles (top load weight of 5 lbs and 4 psi diaphragm pressure). Both the sample and the abradant are identical for each example. Table 1 summarizes the results.

TABLE 1

Abrasion Resistance
Modified* ASTM D3886 - Inflated Diaphragm Method

| EXAMPLES | SAMPLE/ ABRADANT | COATING | RESULT |
|---|---|---|---|
| 1 | A1 | N/A | PASS |
| 2 | D1 | N/A | FAIL |
| 3 | B1 | N/A | FAIL |
| 4 | E1 | N/A | FAIL |
| 5 | C1 | N/A | FAIL |
| 6 | A2 | R300B | PASS |
| 7 | D6 | R300B | PASS |
| 8 | D2 | R300B | PASS |
| 9 | E3 | R300B | PASS |
| 10 | C2 | R300B | PASS |
| 11 | A4 | DC200 | PASS |
| 12 | D2 | DC200 | PASS |
| 13 | B4 | DC200 | PASS |
| 14 | E2 | DC200 | PASS |
| 15 | C4 | DC200 | PASS |

*Modified by: the top load weight (on the abradant) was set at 5 lb. (2.27 kg) and the number of cycles was set to 2000.

This data illustrates the overall improvement in the abrasion resistance of fabrics imparted by the silicone-based coating, compared to the uncoated control samples.

Examples 16-39

Each of the samples were tested for $V_{50}$ against 9 mm, 124 grain bullets following the standardized testing conditions of MIL-STD-662F. Articles of ballistic resistant armor can be designed and constructed so as to achieve a desired $V_{50}$ by adding or subtracting individual layers of ballistic resistant fabric. For the purpose of these experiments (and for examples 1-15), the construction of the articles was standardized by stacking a sufficient number of fabric layers (45) such that the Total Areal Density (TAD) (areal density of fabrics including the fibers and the polymeric binder material) of the article was 1.01±0.03 psf. Table 2 summarizes the results.

TABLE 2

| EXAMPLE | Sample | Areal Weight | TAD | Silicone Type | Processed In Laminator | $V_{50}$ (ft/sec) |
|---|---|---|---|---|---|---|
| 16 | A1 | 1.532 | 0.98 | N/A | N | 1690 (515 m/sec) |
| 17 | A2 | 1.550 | 0.99 | R300B | Y | 1790 (546 m/sec) |
| 18 | A3 | 1.534 | 0.98 | N/A | Y | 1724 (525 m/sec) |
| 19 | B1 | 1.590 | 1.02 | N/A | N | 1693 (516 m/sec) |
| 20 | B2 | 1.547 | 0.99 | R300B | Y | 1722 (525 m/sec) |
| 21 | B3 | 1.545 | 0.99 | N/A | Y | 1648 (502 m/sec) |
| 22 | C1 | 1.544 | 0.99 | N/A | N | 1673 (510 m/sec) |
| 23 | C2 | 1.555 | 1.00 | R300B | Y | 1734 (529 m/sec) |
| 24 | C3 | 1.542 | 0.99 | N/A | Y | 1729 (527 m/sec) |
| 25 | D1 | 1.569 | 1.00 | N/A | N | 1671 (509 m/sec) |
| 26 | D2 | 1.623 | 1.04 | DC 200 | Y | 1713 (522 m/sec) |
| 27 | D3 | 1.566 | 1.00 | R300B | Y | 1737 (529 m/sec) |

TABLE 2-continued

| EXAMPLE | Sample | Areal Weight | TAD | Silicone Type | Processed In Laminator | $V_{50}$ (ft/sec) |
|---|---|---|---|---|---|---|
| 28 | D4 | 1.564 | 1.00 | N/A | Y | 1704 (519 m/sec) |
| 29 | D5 | 1.618 | 1.04 | DC 200 | Y | 1800 (549 m/sec) |
| 30 | D6 | 1.568 | 1.00 | R300B | Y | 1768 (539 m/sec) |
| 31 | D7 | 1.562 | 1.00 | N/A | N | 1719 (524 m/sec) |
| 32 | E1 | 1.588 | 1.02 | N/A | N | 1729 (527 m/sec) |
| 33 | E2 | 1.586 | 1.02 | DC 200 | Y | 1814 (553 m/sec) |
| 34 | E3 | 1.625 | 1.04 | R300B | Y | 1799 (548 m/sec) |
| 35 | E4 | 1.586 | 1.02 | N/A | Y | 1723 (525 m/sec) |
| 36 | E5 | 1.584 | 1.01 | DC 200 | Y | 1774 (541 m/sec) |
| 37 | E6 | 1.619 | 1.04 | R300B | Y | 1741 (531 m/sec) |
| 38 | E7 | 1.589 | 1.02 | N/A | N | 1688 (515 m/sec) |
| 39 | E8 | 1.586 | 1.02 | N/A | N | 1670 (509 m/sec) |

Very unexpectedly, a regression analysis of the above data finds that the presence of a silicone coating raised the 9 mm $V_{50}$ by approximately 65 ft/second (~20 m/sec). Thus the materials of the invention desirably achieve both enhanced abrasion resistance and improved ballistic penetration resistance.

While the present invention has been particularly shown and described with reference to preferred embodiments, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. A ballistic resistant article comprising:

an abrasion resistant composite comprising at least one fibrous substrate having a multilayer coating thereon, wherein said fibrous substrate comprises one or more fibers having a tenacity of about 7 g/denier or more and a tensile modulus of about 150 g/denier or more; said multilayer coating comprising a layer of a non-silicon-containing material on a surface of said one or more fibers, and a topical layer of a silicon-containing material on the non-silicon-containing material layer, wherein said ballistic resistant article is a soft armor article that is a garment or a hard armor article that is a helmet, a panel for a military vehicle, or a protective shield.

2. The ballistic resistant article of claim 1 wherein said silicon-containing coating comprises a silicone-based polymer.

3. The ballistic resistant article of claim 1 wherein said silicon-containing coating comprises a cured thermoset polymer, a non-reactive thermoplastic polymer or an uncured silicon-containing fluid.

4. The ballistic resistant article of claim 1 wherein said silicon-containing coating comprises a silicon-containing antifoam, a silicon-containing lubricant or a silicon-containing release coating.

5. The ballistic resistant article of claim 1 wherein said silicon-containing coating comprises a polymeric organic siloxane.

6. The ballistic resistant article of claim 1 wherein the non-silicon-containing material comprises a polyurethane polymer, a polyether polymer, a polyester polymer, a polycarbonate polymer, a polyacetal polymer, a polyamide polymer, a polybutylene polymer, an ethylene-vinyl acetate copolymer, an ethylene-vinyl alcohol copolymer, an ionomer, a styrene-isoprene copolymer, a styrene-butadiene copolymer, a styrene-ethylene/butylene copolymer, a styrene-ethylene/propylene copolymer, a polymethyl pentene polymer, a hydrogenated styrene-ethylene/butylene copolymer, a maleic anhydride functionalized styrene-ethylene/butylene copolymer, a carboxylic acid functionalized styrene-ethylene/butylene copolymer, an acrylonitrile polymer, an acrylonitrile butadiene styrene copolymer, a polypropylene polymer, a polypropylene copolymer, an epoxy polymer, a novolac polymer, a phenolic polymer, a vinyl ester polymer, a nitrile rubber polymer, a natural rubber polymer, a cellulose acetate butyrate polymer, a polyvinyl butyral polymer, an acrylic polymer, an acrylic copolymer, an acrylic copolymer incorporating non-acrylic monomers or combinations thereof.

7. The ballistic resistant article of claim 1 wherein said fibrous substrate has two surfaces, each comprising a layer of non-silicon-containing material having topical layers of the silicon-containing material substantially coating the layers of non-silicon-containing material.

8. The ballistic resistant article of claim 1 wherein said silicon-containing material comprises from about 0.01% to about 5.0% by weight of said composite.

9. The ballistic resistant article of claim 1 wherein said non-silicon-containing material comprises from about 1% to about 50% by weight of said composite.

* * * * *